US006079633A

United States Patent [19]

Inoue et al.

[11] Patent Number: 6,079,633

[45] Date of Patent: Jun. 27, 2000

[54] LIQUID JETTING APPARATUS AND OPERATION METHOD OF THE LIQUID JETTING APPARATUS

[75] Inventors: Hiroshi Inoue; Tsutomu Takatsuka; Kazuo Sanada, all of Kanagawa, Japan

[73] Assignee: Fuji Photo Film Co., Ltd., Kanagawa, Japan

[21] Appl. No.: 09/099,623

[22] Filed: Jun. 18, 1998

[30] Foreign Application Priority Data

Jun. 19, 1997 [JP] Japan ..... 9-163062

[51] Int. Cl.[7] ..... B05B 17/00; B05B 9/00

[52] U.S. Cl. ..... 239/1; 239/67; 239/71; 239/127; 239/135; 239/566; 239/575; 239/302; 396/564; 396/604; 396/627

[58] Field of Search ..... 239/121, 124, 239/127, 128, 135, 1, 102.1, 102.2, 556, 566, 302, 575, 71, 67; 396/564, 565, 572, 582, 604, 627

[56] References Cited

U.S. PATENT DOCUMENTS

| | | | |
|---|---|---|---|
| 2,981,170 | 4/1961 | Brault | 396/627 X |
| 3,589,263 | 6/1971 | Casey | 396/627 X |
| 4,197,000 | 4/1980 | Blackwood | 396/627 X |
| 4,714,196 | 12/1987 | McEachern et al. | 239/127 X |
| 4,737,810 | 4/1988 | Kobayashi et al. | 396/604 X |
| 4,974,541 | 12/1990 | Miyabayashi | 396/627 X |
| 5,055,870 | 10/1991 | Ohba et al. | 396/627 X |
| 5,137,694 | 8/1992 | Copeland et al. | 239/127 X |
| 5,845,169 | 12/1998 | Patton et al. | 396/564 |

*Primary Examiner*—Andres Kashnikow
*Assistant Examiner*—Steven J. Ganey
*Attorney, Agent, or Firm*—Sughrue, Mion, Zinn, Macpeak & Seas, PLLC

[57] ABSTRACT

An image forming solvent stored in a bottle is sent to a sub tank by a pump. The image forming solvent with the bubbles eliminated at a sub tank with the upper end open is filled into a jetting device having nozzle holes. The water level of the sub tank is kept constant by a discharge pipe communicating with the sub tank at a position lower than the jetting device. As a result, the inside of the jetting device is in a constant negative pressure state so that the atomized image forming solvent is jetted from the jetting device. At this time, the atomized image forming solvent can be jetted stably. The jetting state of the jetting device is not effected by the pulsation of the sub tank pump.

19 Claims, 11 Drawing Sheets

LIQUID JETTING APPARATUS AND OPERATION METHOD OF THE LIQUID JETTING APPARATUS

BACKGROUND OF THE INVENTION

1. Field of the Invention

The present invention relates to a liquid jetting apparatus capable of appropriately jetting an image forming solvent on an image recording material such as a photosensitive material and an image receiving material, and an operation method of the liquid jetting apparatus.

2. Description of the Related Art

An image forming apparatus for conducting an image recording process by using two kinds of image recording materials, such as a photosensitive material and an image receiving material is known.

Inside this kind of image forming apparatus, an image forming solvent application section having a vessel for storing an image forming solvent to be applied to a photosensitive material is provided, and further, a heat developing transfer section comprising a heat drum and an endless press belt which rotates with the heat drum while pressing the outer periphery of the heat drum is provided.

The photosensitive material with the image exposed in the image forming apparatus while being held and conveyed is soaked in a vessel filled with water acting as the image forming solvent in the image forming solvent application section, then sent to the heat developing transfer section. At the same time, the image receiving material is also sent to the heat developing transfer section in the same way as the photosensitive material.

In the heat developing transfer section, the photosensitive material applied with water is superimposed with the image receiving material and wound closely around the outer periphery of the heat drum in this superimposed state. Further, both materials are held and conveyed between the heat drum and the endless press belt so that the photosensitive material is heat developed while the image is transferred onto the image receiving material. In this way, specified images can be formed (recorded) on the image receiving material.

However, since the photosensitive material is soaked in the vessel filled with water acting as the image forming solvent, water coming into contact with the photosensitive material is kept in the vessel at all times. As a result, bacteria in the vessel uses organic substances released from the photosensitive material in tiny amounts as a nutrition source and multiply. This fouls the water and increases the risk of deterioration of the image forming apparatus itself and image quality.

Therefore, an application method of jetting and spraying small water droplets from a jetting device filled with water on to the photosensitive material while vibrating a nozzle plate having nozzle holes without the water supply side, for example a vessel, coming into contact with the photosensitive material can be considered.

However, if bubbles enter the jetting device along with water from a water supply pipe when supplying water to the jetting device, the bubbles prevent stable jetting of water from the nozzle holes so as to disturb stable spraying, and thus homogeneous application of water onto a photosensitive material becomes difficult. Further, a risk is involved in that the water pressure may be applied excessively from the water pipe to the jetting device at the time of supplying water to the jetting device so that the water may accidentally leak from the nozzle holes.

Therefore, a method of carefully supplying water into the jetting device may be thought of, but, by supplying water carefully, the water supply time can increase and thus it is disadvantageous in that the waiting time before water jetting increases.

On the other hand, a water supply to the jetting device is required because water is lost during the spraying and jetting of water from the nozzle holes. However, if the water pressure is changed in the water supplied to the jetting device by the water supplied, the water jetting amount fluctuates and disturbs stable spraying, and thus is disadvantageous.

Furthermore, if water supplied into the jetting device contains a contaminant or a calcium component, which can generate scale, the nozzle holes of the jetting device can get choked and disturb stable jetting, and thus this too is disadvantageous.

SUMMARY OF THE INVENTION

In light of the above-mentioned problems, an object of the present invention is to provide a liquid jetting apparatus capable of stably spraying without the risk of inadvertently leaking water from nozzle holes while shortening the waiting time, and an operation method of the liquid jetting apparatus.

A first aspect of the present invention comprises a bottle for storing an image forming solvent, a sub tank with the open upper end for temporarily storing the image forming solvent, a pump for sending the image forming solvent in the bottle to the sub tank side, a jetting device communicating with the sub tank so as to be filled with the image forming solvent from the sub tank side, provided with a plurality of nozzle holes for jetting the image forming solvent, and a discharge pipe communicating with the sub tank at a position lower than the jetting device so as to keep the water level of the image forming solvent stored in the sub tank constant.

According to the first aspect of the present invention, the image forming solvent stored in the bottle is sent by pump to the sub tank side with the open upper end, and the sub tank temporarily stores the image forming solvent. According to this, the image forming solvent is filled from the sub tank side to the jetting device communicating with the sub tank.

Further, the discharge pipe communicating with the sub tank at a position lower than the jetting device keeps the water level of the image forming solvent stored in the sub tank lower than the level of the jetting device. Accordingly, the plurality of the nozzle holes in the jetting device jet the image forming solvent while maintaining the inside of the jetting device at a constant negative pressure.

Therefore, image forming solvent is charged from the sub tank into the jetting device in a constant negative pressure state by the spraying operation for jetting the image forming solvent from the nozzle holes.

At this time, since the sub tank which keeps the water level of the image forming solvent stored lower than the jetting device is provided between the bottle and the jetting device, water pressure variations occurring when the image forming solvent is charged by the pump can be offset by the sub tank. Therefore, water pressure variations do not occur in the image forming solvent filled in the jetting device.

Further, bubbles contained in the image forming solvent in the sub tank can be eliminated.

According to the effects, the image forming solvent can be sprayed stably. As a result, the image forming solvent can be applied homogeneously.

Moreover, since water does not need to be charged into the jetting device with great caution, the waiting time for jetting the image forming solvent by the liquid jetting apparatus can be reduced.

A second aspect of the present invention comprises a water level adjusting valve which is provided in the discharge pipe to open and close the discharge pipe, and to discharge excessive sub tank image forming solvent in order to keep the water level of the image forming solvent stored in the sub tank lower than the jetting device in the open state.

According to the second aspect of the present invention, the image forming solvent stored in the bottle with the water level adjusting valve closed is sent by pump to the sub tank side with the upper open end so that the sub tank temporarily stores the image forming solvent. Accordingly, the image forming solvent is filled from the sub tank side to the jetting device communicating with the sub tank.

Furthermore, by opening the water level adjusting valve for opening or closing the discharge pipe communicating with the sub tank at a position lower than the jetting device after filling the image forming solvent in the jetting device, excessive sub tank image forming solvent is discharged so that the water level of the image forming solvent stored in the sub tank at a water level lower than the jetting device can be maintained constantly.

Accordingly, the water level of the sub tank can be easily adjusted by opening or closing the water level adjusting valve.

A third aspect of the present invention comprises a jetting device switching valve, communicating with the jetting device for opening or closing the inside of the jetting device.

According to the third aspect of the present invention, the image forming solvent stored in the bottle is sent by pump to the sub tank side with the open upper end so that the sub tank temporarily stores the image forming solvent. Accordingly, the image forming solvent is filled from the sub tank side into the jetting device communicating with the sub tank.

Further, when the water level of the image forming solvent in the sub tank is maintained at a water level lower than the jetting device, the previously opened jetting device switching valve is closed to maintain the water level of the image forming solvent filled in the jetting device.

Accordingly, the image forming solvent is jetted from a plurality of nozzle holes provided in the jetting device in a state where the inside of the jetting device is maintained at a constant negative pressure and the water level of the image forming solvent in the jetting device is maintained.

A fourth aspect of the present invention comprises a sensor for detecting water levels in the sub tank at positions higher than the jetting device.

According to the fourth aspect of the present invention, the water level inside the sub tank rises as the image forming solvent is filled in the jetting device and the sensor detects the water level inside the sub tank at a position higher than the jetting device. If the water level in the sub tank is detected by the sensor, the water level adjusting valve which opens and closes the discharge pipe communicating with the sub tank at a position lower than the jetting device is opened so as to discharge excessive sub tank image forming solvent. This keeps the water level of the image forming solvent stored in the sub tank at a water level lower than the jetting device.

Therefore, the rise of the water level in the sub tank to a level higher than a predetermined position can be prevented by the sensor so as to prevent inadvertent leakage of the image forming solvent from the nozzle holes of the jetting device.

A fifth aspect of the present invention comprises an overflow channel for connecting the jetting device and the bottle via the jetting device switching valve.

According to the fifth aspect of the present invention, the image forming solvent is filled in the jetting device by opening the jetting device switching valve, and after filling, the inside of the jetting device can be kept in a constant negative pressure state by closing the jetting device switching valve.

At this time, since the image forming solvent overflowed from the jetting device switching valve is taken to and kept in the bottle via the overflow channel, the image forming solvent can be utilized very effeciently.

A sixth aspect of the present invention comprises a bottle for storing an image forming solvent, a sub tank with the open upper end for temporarily storing the image forming solvent, a pump for sending the image forming solvent from the bottle to the sub tank side, a jetting device communicating with the sub tank so as to be filled with the image forming solvent from the sub tank side, provided with a plurality of nozzle holes for jetting the image forming solvent, a circulating pipe, connecting a part of the sub tank lower than the part communicating with the jetting device so as to comprise a part of a circulating path, and the bottle for circulating the image forming solvent, a circulating path switching valve provided in the circulating pipe for opening or closing the circulating path, and a filter provided in the circulating path for filtrating the image forming solvent.

According to the sixth aspect of the present invention, the image forming solvent stored in the bottle is sent by pump to the sub tank side with the open upper end, and the sub tank temporarily stores the image forming solvent. Then, the image forming solvent is filled from the sub tank side into the jetting device communicating with the sub tank.

Further, the circulating pipe connecting the part of the sub tank lower than the part communicating with the jetting device and the bottle comprises a part of a circulating path for circulating the image forming solvent. The circulating path switching valve opens and closes the circulating path. The filter provided in the circulating path filtrates the image forming solvent.

Therefore, by driving the pump with the circulating path switching valve open at the time of starting the operation of the liquid jetting apparatus, the image forming solvent runs from the bottle to the filter, the sub tank, and the circulating pipe and returns to the bottle. Therefore, even if a contaminant, and the like, is contained in the image forming solvent, it is eliminated by the filter provided in the circulating path, and thus the nozzle holes of the jetting device cannot be choked by a contaminant, and the like, so that stable spraying of the image forming solvent can be ensured.

A seventh aspect of the present invention comprises a heater provided in the circulating path for maintaining the image forming solvent at a constant temperature.

According to the seventh aspect of the present invention, since the heater is provided in the circulating path, the temperature of the image forming solvent can be controlled so that the waiting time for the jetting of the image forming solvent by the liquid jetting apparatus to start can be shortened.

An eighth aspect of the present invention comprises a step of filling an image forming solvent into a jetting device communicating with a sub tank as the image forming solvent stored in a bottle is sent by pump to the sub tank side to be temporarily stored, a step of opening a water level adjusting valve for opening or closing a discharge pipe communicating with the sub tank to keep the water level of the image forming solvent stored in the sub tank lower than the jetting device, a step of jetting the image forming solvent from a plurality of nozzle holes provided in the jetting device, and a step of opening a jetting device switching valve for opening or closing in the jetting device so as to discharge the image forming solvent in the jetting device upon completion of the jetting operation of the image forming solvent.

According to the eighth aspect of the present invention, the image forming solvent is filled into the jetting device as the image forming solvent stored in the bottle is sent by pump to be temporarily stored in the sub tank.

Then, by opening the water level adjusting valve, the water level in the image forming solvent stored in the sub tank is kept lower than the jetting device, then, the image forming solvent is jetted from the plurality of nozzle holes provided in the jetting device.

Upon completion of the jetting operation of the image forming solvent, the image forming solvent in the jetting device is discharged by opening the jetting device switching valve.

Therefore, bubbles are eliminated by the sub tank when supplying water to the jetting device to prevent bubbles entering the jetting device and thereby stabilize the spraying operation. Further, excessive water pressure is not applied from the sub tank in the jetting device so that leakage of the image forming solvent from the nozzle holes can be prevented.

Accordingly, water need not be supplied with great caution into the jetting device. This means that the waiting time before starting the jetting operation of the image forming solvent by the liquid jetting apparatus can be shortened.

On the other hand, as the spraying operation of jetting the image forming solvent by the nozzle holes, the image forming solvent is charged into the jetting device. At this time, the sub tank that constantly keeps the water level of the image forming solvent lower than the jetting device, offsets water pressure variations occurring when the image forming solvent is charged by the pump. Therefore, water pressure variations do not occur in the image forming solvent filled in the jetting device and so a stable spraying operation is possible.

A ninth aspect of the present invention comprises a step of filling the image forming solvent in the jetting device to keep the water level in the sub tank lower than the jetting device and of closing the previously opened jetting device switching valve.

According to the ninth aspect of the present invention, the image forming solvent is filled into the opened jetting device by the jetting device switching valve as the image forming solvent stored in the bottle is sent by the pump to be temporarily stored in the sub tank.

Then, by opening the water level adjusting valve, the water level in the image forming solvent stored in the sub tank is kept lower than the jetting device. Then, the jetting device switching valve is closed with the inside of the jetting device at a constant negative pressure state.

Accordingly, the image forming solvent is jetted from the plurality of the nozzle holes provided in the jetting device.

At this time, the jetting device switching valve is closed after the water level in the sub tank becomes lower than the jetting device. Accordingly, leakage of the image forming solvent from the nozzle of the jetting device can be prevented by closing the jetting device switching valve.

A tenth aspect of the present invention comprises a step of circulating the image forming solvent ground the circulating path from the bottle and returning it to the bottle via the sub tank to eliminate contaminants and the like from the image forming solvent with a filter provided in the circulating path before filling the image forming solvent into the jetting device.

According to the tenth aspect of the present invention, the image forming solvent circulates in the circulating path via the bottle and the sub tank to eliminate contaminants, and the like with the filter before filling the image forming solvent into the jetting device. Therefore, since contaminants, and the like can be eliminated before contaminated image forming solvent reaches the jetting device, contaminated image forming solvent does not reach the jetting device and so choking of the nozzle holes can be prevented.

An eleventh aspect of the present invention comprises a step of discharging the image forming solvent from the jetting device so as to be returned to the sub tank, and circulating the image forming solvent in the circulating path at predetermined time intervals so as to maintain the temperature of the image forming solvent at a predetermined temperature with a heater provided in the circulating path.

According to the eleventh aspect of the present invention, the image forming solvent circulates in the circulating path at predetermined time intervals so as to be maintained at a predetermined temperature by the heater while waiting for the jetting of the image forming solvent. Therefore, when the image forming solvent is actually jetted, the waiting time can be reduced.

DESCRIPTION OF THE PREFERRED EMBODIMENTS

Figure 1:
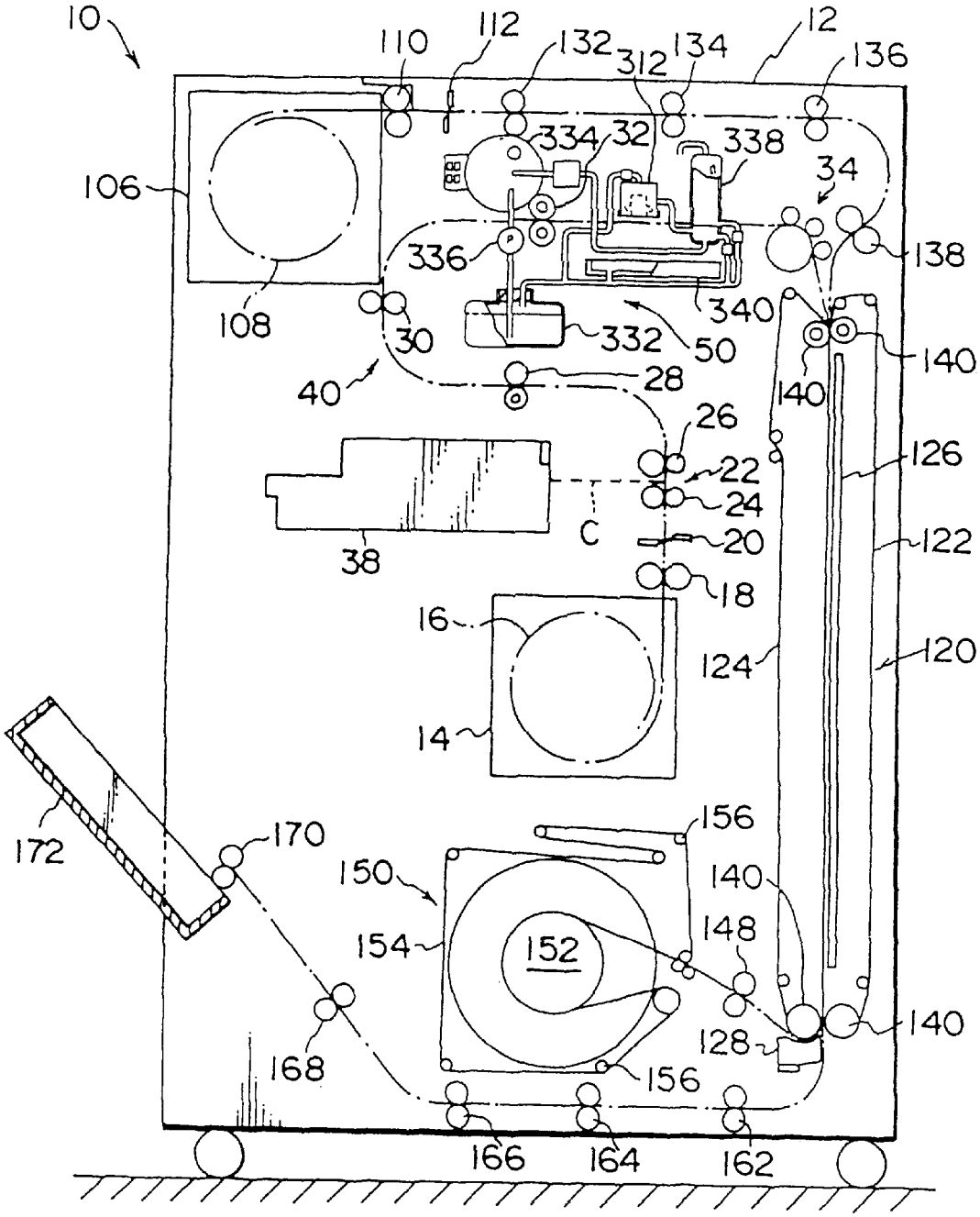
FIG. 1 is a schematic diagram of the entire configuration of an image recording device according to one embodiment of the present invention.

FIG. 1 is a schematic diagram of the entire configuration of an image recording device 10, which is an image forming device according to one embodiment of the present invention.

In the base 12 of the image recording device 10 shown in FIG. 1, a photosensitive material magazine 14 for storing a photosensitive material 16 is provided and the photosensitive material 16 is wound around the photosensitive material magazine 14 in a roll-like manner such that the photosensitive (exposure) surface of the photosensitive material 16 drawn from the photosensitive material magazine 14 faces the left side.

A nip roller 18 and a cutter 20 are provided near the exit of the photosensitive magazine 14 from which the photosensitive material is taken out. In this way, the photosensitive material 16 can be cut at predetermined lengths when being drawn from the photosensitive material magazine 14. The cutter 20 can be a rotary type cutter comprising a fixed blade and a movable blade so that the photosensitive material 16 can be cut by coming into contact with the fixed blade through vertically moving the movable blade with a rotating cam, and the like.

A plurality of conveying rollers 24, 26, 28, 30, 32, 34 are provided successively downstream in the conveying direction of the photosensitive material 16 and in opposition to the cutter 20, with a guide plate (not illustrated) provided between each pair of adjacent conveying rollers. The photosensitive material 16 cut at predetermined lengths is conveyed to an exposing section 22 provided between the conveying rollers 24, 26.

An exposing device 38 is provided on the left side of the exposing section 22. Three kinds of LDs, a lens unit, a polygon mirror, and a mirror unit (not illustrated) are provided in the exposing device 38 so that the light beam C can be sent from the exposing device 38 to the exposing section 22 and thus expose the photosensitive material 16.

Further, a U turn section 40 for conveying the photosensitive material 16 bent in a U-shape and a water applying section 50 for applying the image forming solvent are provided above the exposing section 22. In this embodiment, water is used as the image forming solvent.

The photosensitive material 16 raised from the photosensitive magazine 14 and exposed at the exposing section 22 is held and conveyed by the conveying rollers 28, 30 so as to be sent to the water applying section 50 while passing through the conveying path at the upper side of the U turn section 40.

Figure 2:
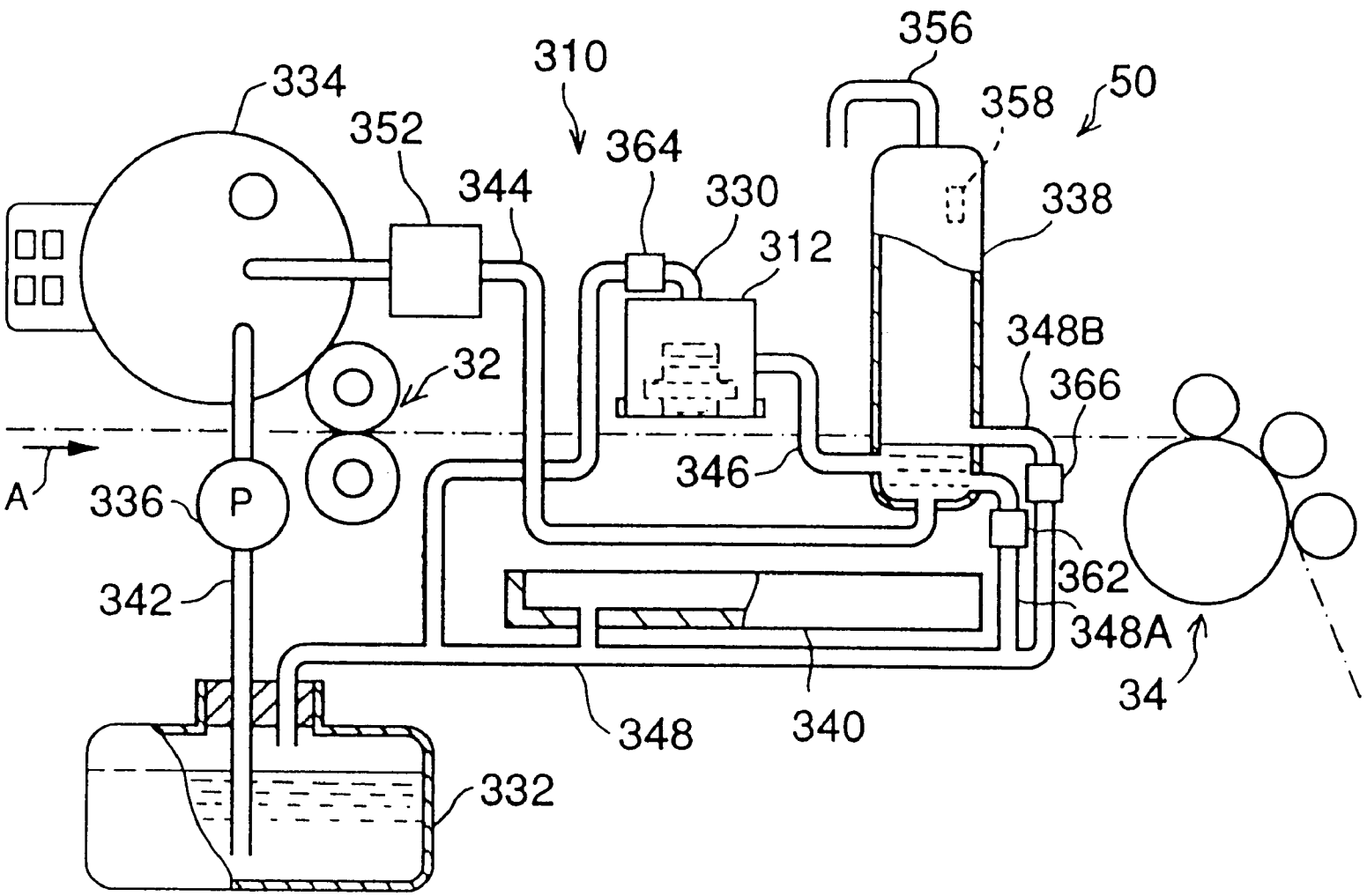
FIG. 2 is a schematic diagram of the entire configuration of an applying device according to one embodiment of the present invention.

On the other hand, as shown in FIG. 2, a jetting tank 312 which is actually a jetting device comprising a part of an applying device 310 which in turn is a liquid jetting apparatus is provided at a position facing the conveying path A of the photosensitive material 16 in the water applying section 50.

As shown in FIG. 2, a water bottle 332 for storing water to be supplied to the jetting tank 312 is provided below and to the left of the jetting tank. A filter 334 for filtering water is provided above the water bottle 332. A water supply pipe 342 with a pump 336 provided therein connects the water bottle 332 to the filter 334.

Figure 8:
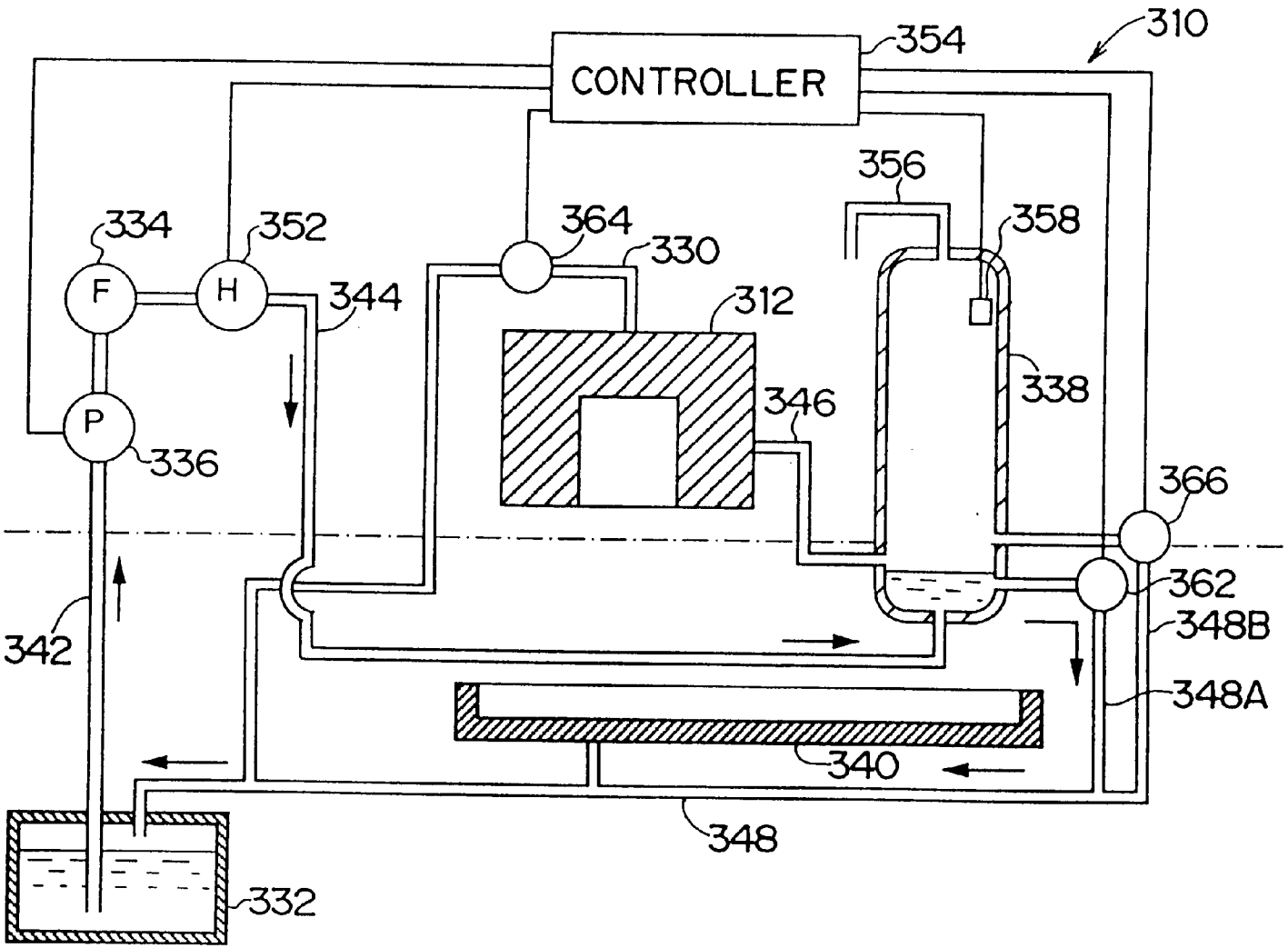
FIG. 8 is a piping diagram of an applying device according to one embodiment of the present invention, showing the water flow when the operation of the applying device is initiated.

A columnar sub tank 338 for temporarily storing water sent from the water bottle 332 is provided on the right side of the jetting tank 312. The water supply pipe 344 extends from the filter 334 to the bottom of the sub tank 338. A heater 352 for controlling the temperature by heating water is provided in the water supply pipe 344. As shown in FIG. 8, the pump 336 and the heater 352 are connected to a controller 354 for controlling the operation thereof.

Therefore, when the operation of the pump 336 and the heater 352 are started by the controller 354, water is sent from the water bottle 332 to the filter 334 side by the pump 336, further filtrated through the filter 334, heated by the heater 352, and sent to the sub tank 338 and temporarily stored there.

A ventilation pipe 356 reaching outside and able to open is attached to the upper end part of the sub tank 338 so that the inside and the outside of the sub tank 338 are in contact via the ventilation pipe 356 which allows the air pressure in the sub tank 338 to be kept at atmospheric pressure. As shown in FIGS. 2 and 8, a liquid level sensor 358 for detecting the water level in the sub tank 338 is provided at a position in the upper part of the sub tank 338 higher than the jetting tank 312 so that overflow of the water from the sub tank 338 is prevented. A liquid level sensor using an electrode and the like can be used.

A water supply pipe 346 connecting the lower part of the sub tank 338 and the near side of the jetting tank 312 is provided therebetween so that water sent from the water bottle 332 via the filter 334, the heater 352, the sub tank 338, the water supply pipe 346, and the like by the pump 336 is charged and filled into the jetting tank 312.

A tray 340 connected to the water bottle 332 by the circulating pipe 348 is provided in the lower part of the jetting tank 312 so that water overflowing from the jetting tank 312 is collected in the tray 340 and returned to the water bottle 332 via the circulating pipe 348.

One end of the circulating pipe 348 is branched out to a pair of interlocking pipes 348A, 348B so that they are connected to lower and upper positions interposing a part of the water supply pipe 346 communicating with the jetting tank 312. A lower discharge valve 362, which is a circulating path switching valve, is connected to the interlocking pipe 348A connected with the sub tank 338 on the lower side. An upper discharge valve 366, which is a water level adjusting valve, is connected to the interlocking pipe 348B connected with the sub tank 338 on the upper side. The interlocking pipe 348B is connected with the sub tank 338 at a position lower than the jetting tank 312 as shown in FIG. 2.

Therefore, by opening at least the lower discharge valve 362 or the upper discharge valve 366, excessive water stored in the sub tank 338 can be returned to the water bottle 332 via the pair of the interlocking pipes 348A, 348B.

Accordingly a discharge pipe connected to the sub tank 338 at a position lower than the jetting tank 312 at one end and connected to the water bottle 332 at the other end to keep the water level in the sub tank 338 constant can be provided with the interlocking pipe 348B and the circulating pipe 348. Further, the circulating pipe, for connecting the part of the sub tank 338 lower than the part communicating with the jetting tank 312, and the water bottle 332 are provided with the interlocking pipe 348A and the circulating pipe 348 so that a circulating path for circulating water can be provided with them and the water sending pipes 342, 344.

Figure 4:
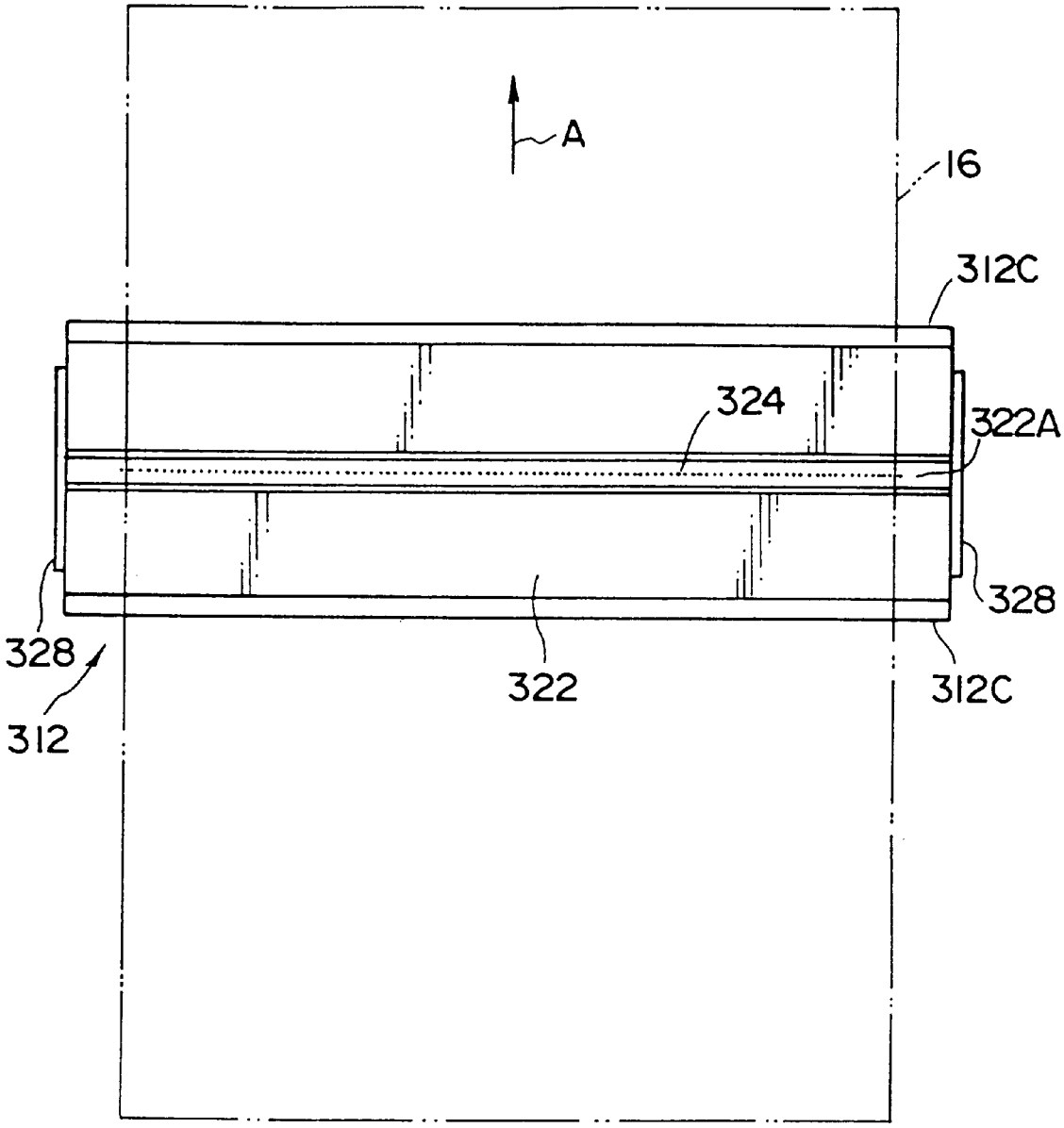
FIG. 4 is a bottom view showing the state of conveying a photosensitive material below the jetting tank according to one embodiment of the present invention.
Figure 6:
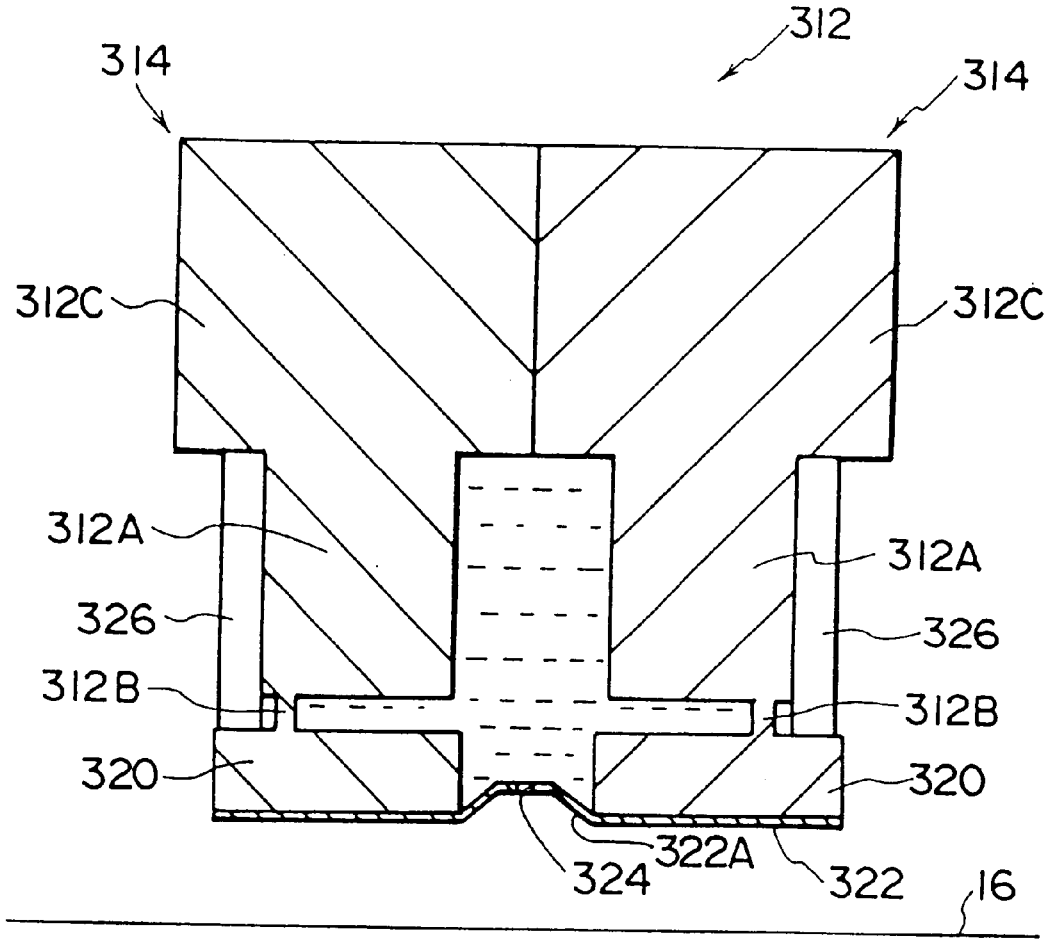
FIG. 6 is a cross-sectional view of a jetting tank according to one embodiment of the present invention.

AS shown in FIGS. 4 and 6, a nozzle plate 322 comprising an elastically deformable rectangular thin plate material (with a plate thickness of, for example, 60 $\mu$m or less) is provided at a part facing the conveying path A of the photosensitive material 16 functioning as the bottom wall surface of the jetting tank 312.

Figure 3:
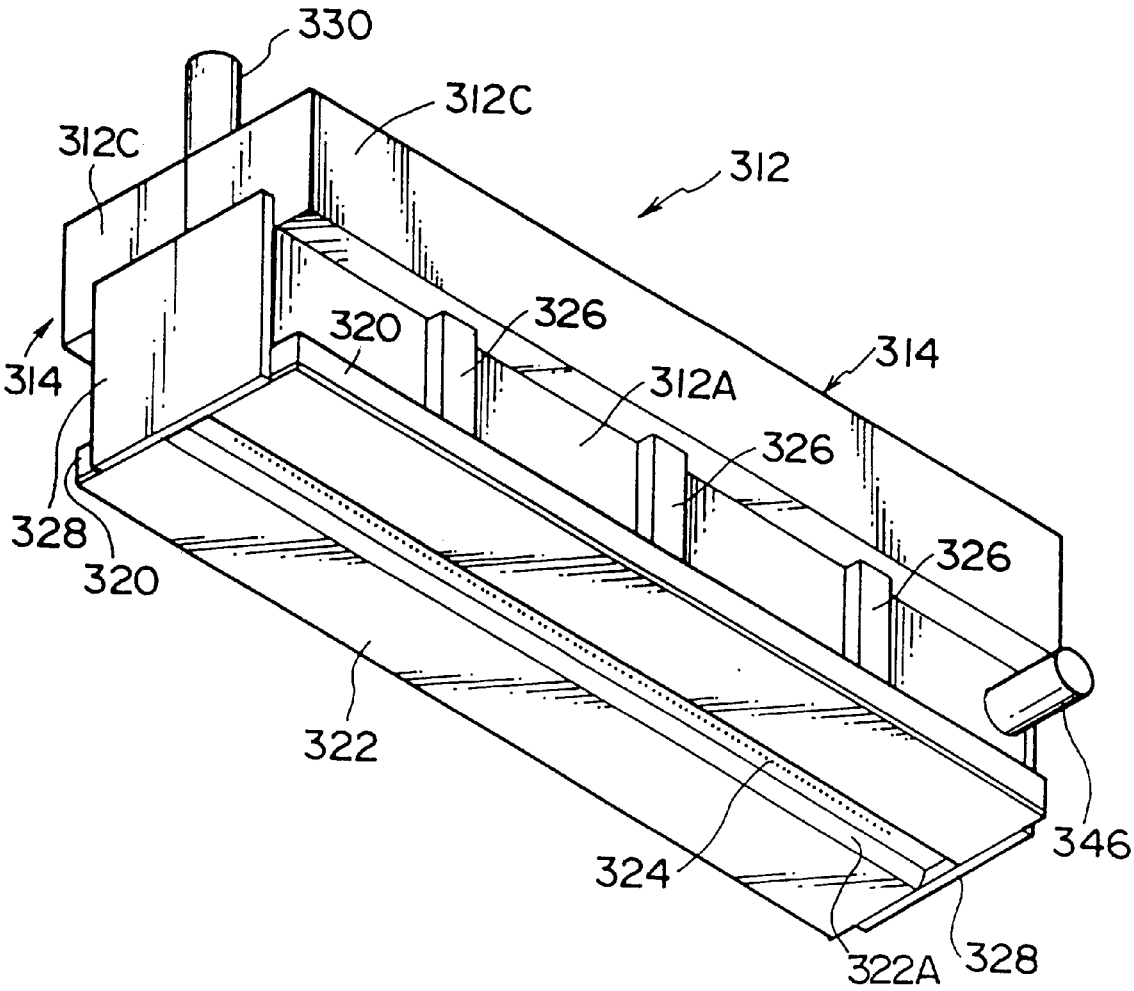
FIG. 3 is an enlarged perspective view of a jetting tank according to one embodiment of the present invention.
Figure 5:
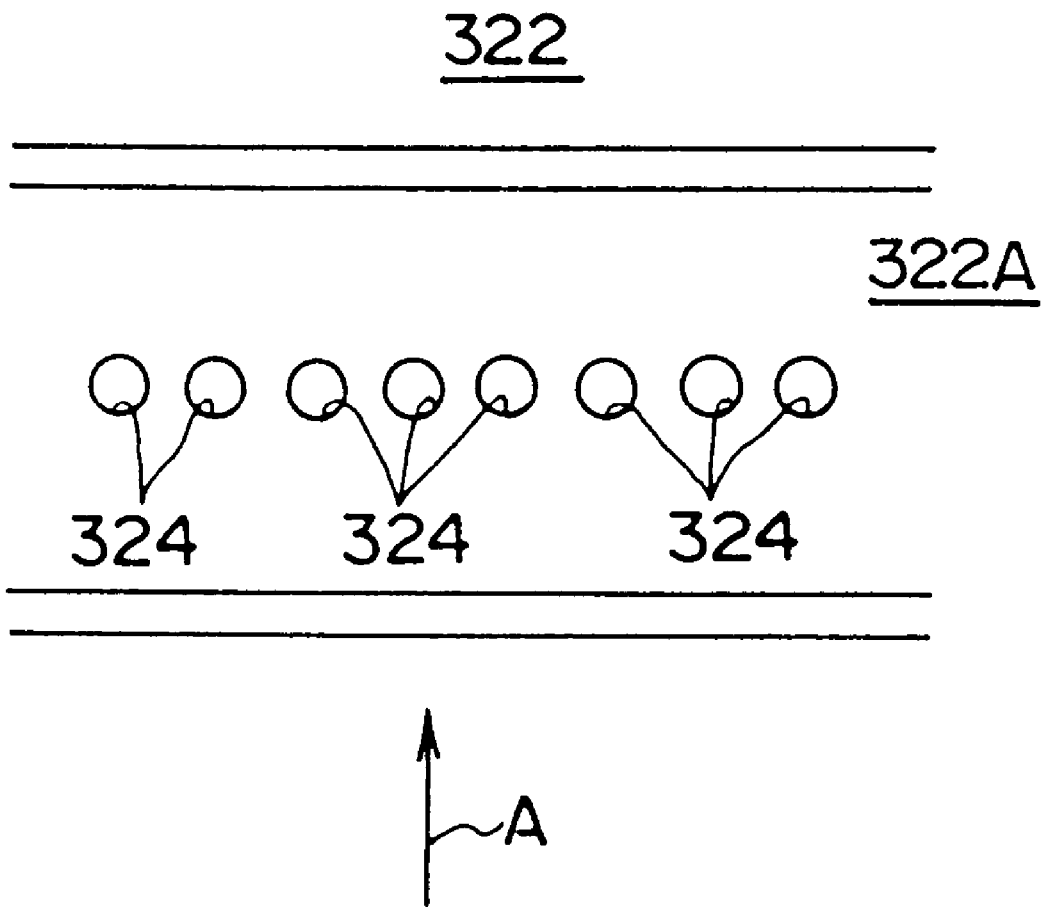
FIG. 5 is an enlarged view of part of FIG. 4.

As shown in FIGS. 3 to 5, a plurality of nozzle holes 324 (with a diameter of, for example, 100 to 200 $\mu$m) for jetting water filled in the jetting tank 312 are provided in the nozzle plate 322 linearly in a direction crossing the conveying direction A of the photosensitive material 16 at set intervals across the entire width of the photosensitive material 16. Therefore, the water in the jetting tank 312 can be discharged on to the photosensitive material 16 side from the nozzle holes 324.

A groove part 322A elongating in the direction where the plurality of the nozzle holes 324 are linearly provided is formed in a bent manner to improve the rigidity of the nozzle plate 322 in the longitudinal direction thereof, which is the direction in which the plurality of nozzle holes 324 are arranged.

On the other hand, as shown in FIGS. 2 and 3, a communicating pipe 330 elongates from the upper part of the jetting tank 312 opposite the part connected with the water sensing pipe 346 to the circulating pipe 348 so that the communicating pipe 330 returns the water overflowed from the jetting tank 312 via the circulating pipe 348.

A tank switching valve 364, which is the jetting device switching valve for opening and closing the communicating pipe 330 is provided in the communicating pipe 330 and thus the inside of the jetting tank 312 can be opened or closed with respect to the water bottle 332 by opening or closing the tank switching valve 364.

Further, the lower discharge valve 362, the tank switching valve 364 and the upper discharge valve 366 comprise electromagnetic valves and are each connected with the controller 354. The controller 354, controls the opening and closing operation of each of the valves 362, 364, 366.

Both end parts of the nozzle plate 322, which are provided at a right angle to the longitudinal direction of the nozzle row comprising the plurality of linearly arranged nozzle holes 324, are bonded with an adhesive to a pair of lever plates 320 acting as a displacement transmitting member as shown in FIG. 6. By virtue of this connection by bonding, the nozzle plate 322 and the pair of lever plates 320 are interlocked. The pair of lever plates 320 are fixed to a pair of side walls 312A via narrow supporting parts 312B elongating in the direction in which the plurality of nozzle holes 324 are linearly arranged. The pair of lever plates 320 are provided below the pair of the side walls 312A of the jetting tank 312.

On the other hand, a part of a pair of top walls 312C comprising the top surface of the jetting tank 312 while in contact with each other projects outside the jetting tank 312. A plurality of piezoelectric elements 326 (in this embodiment, 3 pieces for each end) function as an actuator are bonded to the lower side of the projecting top walls 312C. The outer end side of the lever plates 320, which are a part of the lever plate provided opposite to the plurality of the nozzle holes 324 with respect to the supporting parts 312B, are bonded to the lower side of the piezoelectric elements 326 so as to interlock the piezoelectric elements 326 and the lever plates 320.

Therefore, the lever mechanism can be formed by the piezoelectric elements 326, the lever plates 320 and the supporting parts 312B, so that when the outer end side of the lever plates 320 is moved by the piezoelectric elements it swings around the supporting parts 312B. The inner end side of the lever plates 320 is moved in the opposite direction. The piezoelectric elements 326 are made from, for example, laminated piezoelectric ceramics with the displacement of the piezoelectric elements 326 in the axial direction enlarged. The piezoelectric elements 326 are connected to a power source (not illustrated) and the timing of voltage application is controlled by the controller 354.

On the other hand, the lever plates 320, the side walls 312A, the supporting members 312B and the top walls 312C respectively comprise a part of the integrally-formed frames 314. As shown in FIG. 6, by screwing a pair of the frames 314 side by side with bolts (not illustrated), the outer frame of the jetting tank 312 can be formed with the pair of the lever plates 320, the pair of the side walls 312A, the pair of the top walls 312C and the pair of the supporting members 312B, all adjacent to their respective partners.

The frames 314 are made with a metal material such as aluminum, brass, magnesium, and the like.

It follows from the above that a homogeneous and large amplitude of the nozzle plates 322 can be obtained along the direction where the plurality of the nozzle holes 324 are arranged linearly with a small number of piezoelectric elements 326. Therefore, a homogeneous amplitude distribution along the photosensitive material 16 width direction, and an amplitude able to produce water pressure in the vicinity of each nozzle hole 324 sufficient to attain a sprayable pressure, can be provided. As a consequence, substantially homogeneous spraying with water jetted from the plurality of the nozzle holes 324 to the entirety of the photosensitive material 16 in the width direction is possible.

As shown in FIGS. 3 and 4, a compartmented section comprising the left and right ends of the nozzle plates 322, which are end parts of the nozzle plates 322 provided in the longitudinal direction of the nozzle row formed by the nozzle holes 324, and end parts of the pair of the frames 314 is provided with thin sealing plates 328 bonded to the pair of frames 314.

Further, an elastic adhesive, such as a silicone rubber adhesive is filled in the gap between the right and left end of the nozzle plates 322, the end part of the pair of the frames 314, and the sealing plates 328 to prevent water leakage therefrom. Therefore, the gap in the jetting tank 312 can be sealed with an elastic adhesive without hindering movement in the right and left ends of the nozzle plates 322. It is also possible to seal the right and left ends of the jetting tank 312 with only an elastic adhesive. Thin sealing plates 328 can be dispensed with.

Figure 7:
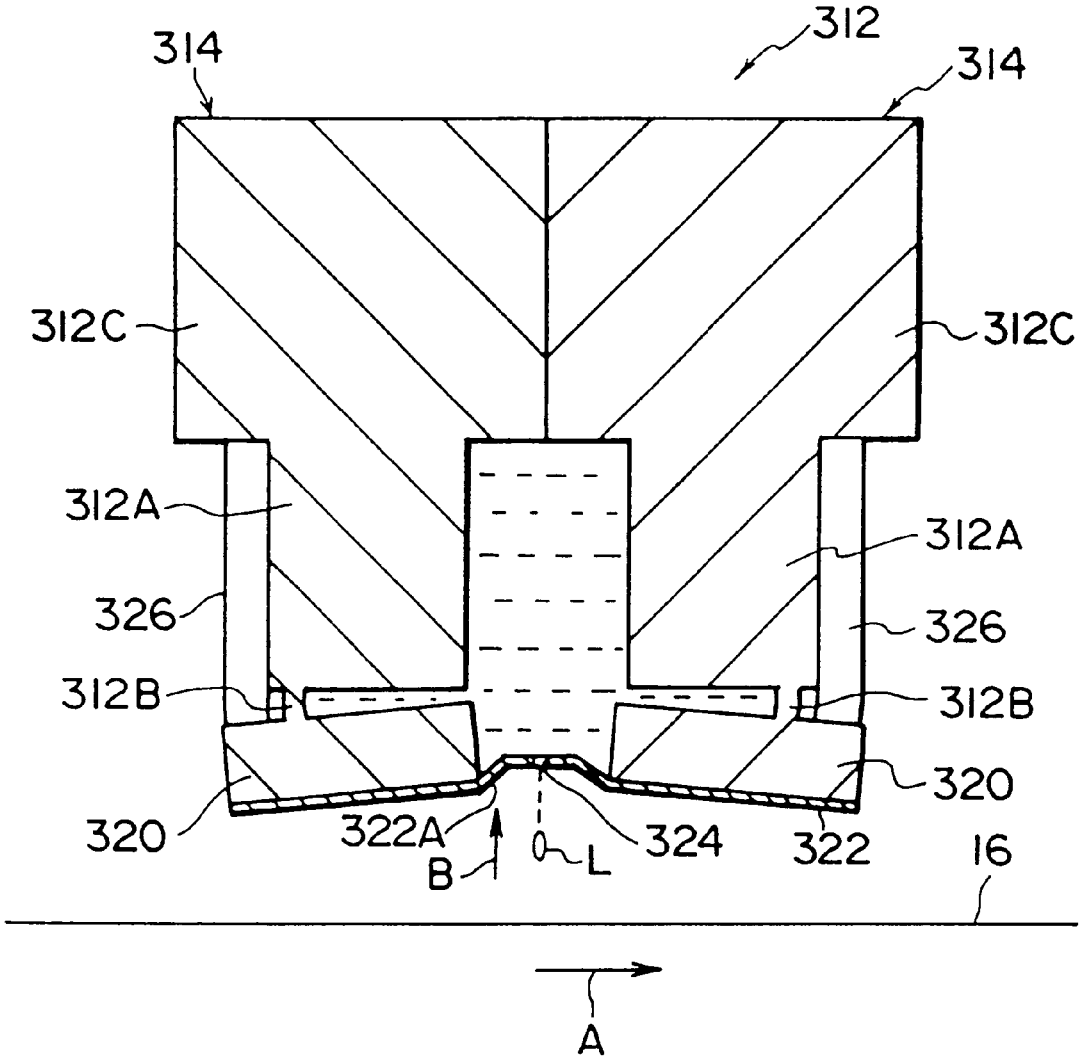
FIG. 7 is a cross-sectional view showing water being jetted from a jetting tank according to one embodiment of the present invention.

Accordingly, when electric power is applied to the piezoelectric elements 326 from the power source, the piezoelectric elements 326 extend and rotate the lever plates 320 around the supporting parts 312B as shown in FIG. 7. Accordingly, the piezoelectric elements 326 deform and displace the nozzle plates 322 such that the piezoelectric elements 326 raise the center part of the nozzle plates 322 in the direction of arrow B. According to the deformation of the nozzle plate 322, the water pressure in the jetting tank 312 can be increased so that droplets L from a slight amount of water from the nozzle holes 324 can be jetted together and linearly.

By applying voltage to the piezoelectric elements 326 repeatedly and stretching the piezoelectric elements 326, the droplets L can be jetted continuously from the nozzle holes 324.

On the other hand, as shown in FIG. 1, an image receiving material magazine 106 is provided on the left upper end part of the base 12 for storing the image receiving material 108. A pigment fixing material containing a mordant is applied to the image forming surface of the image receiving material. The image receiving material 108 is wound around the image receiving material magazine 106 in a roll-like manner such that the image forming surface of the image receiving material 108 drawn from the image receiving material magazine 106 faces downward.

A nip roller 110 is provided near the image receiving material exit of the image receiving material magazine 106. The nip roller 110 nips and draws the image receiving material 108 from the image receiving material magazine 106 as well as removing the nip.

A cutter 112 is provided on the side of the nip roller 110. Like the above-mentioned cutter 20 for the photosensitive material, the cutter 112 comprises, for example, a rotary type cutter comprising a fixed blade and a movable blade. Therefore, by engaging the movable blade with the fixed blade by vertically moving a rotating cam, and the like, the image receiving material 108 drawn from the image receiving material magazine 106 can be cut at lengths shorter than the photosensitive material 16.

Conveying rollers 132, 134, 136, 138 and a guide plate (not illustrated) are provided on the side of the cutter 112 so that the image receiving material 108 cut at a predetermined lengths can be conveyed to the side of the heat developing transfer section 12.

Figure 11:
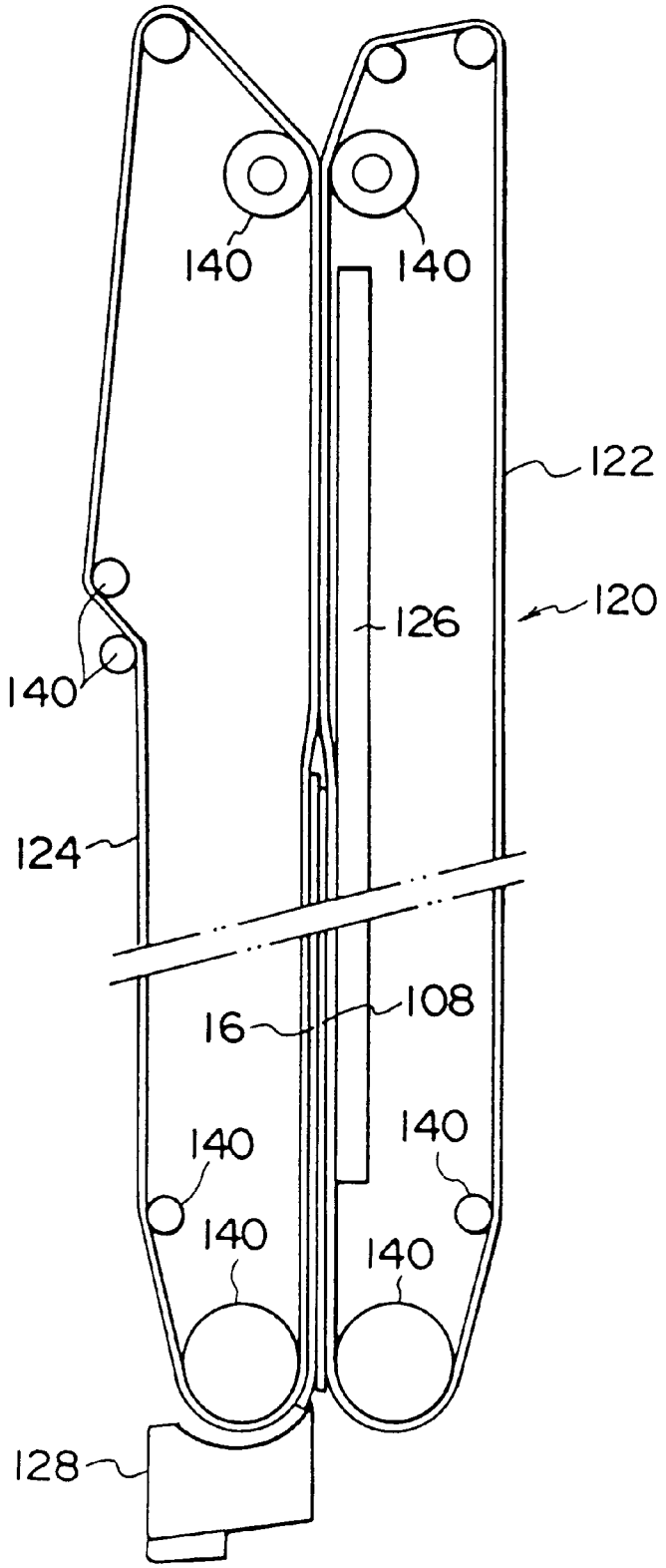
FIG. 11 is an enlarged view of a heat developing transfer section according to one embodiment of the present invention.

As shown in FIGS. 1 and 11, the heat developing transfer section 120 has a pair of endless belts 122, 124 wound around a plurality of wrapped rollers 140 in a loop-like manner longitudinally in the vertical direction. Therefore, when either of the wrapped rollers 140 is driven, the pair of endless belts 122, 124 wound around the wrapping rollers 140 are spun.

A flat heating plate 126 is provided longitudinally in the vertical direction while facing the inner periphery part of the left side of the endless belt 122 in the loop of the right side endless belt 122 from the pair of the endless belts 122, 124 in the figure. A linear heater (not illustrated) is provided in the heating plate 126 so that the temperature of the surface of the heating plate 126 can be raised to a predetermined temperature.

Therefore, the photosensitive material 16 is sent between the pair of the endless belts 122, 124 of the heat developing transfer section 120 by the last conveying roller 34 in the conveying path. The image receiving material 108 is conveyed synchronously with the conveyance of the photosensitive material 16 and sent between the pair of endless belts 122, 124 of the heat developing transfer section 120 by the last conveying roller 138 of the conveying path. The photosensitive material precedes the image receiving material by a predetermined distance and the image receiving material is superimposed on the photosensitive material 16.

In this case, since the image receiving material 108 is smaller than the photosensitive material 16 both in width and length, the four sides of the photosensitive material 16 are superimposed projecting from the periphery part of the image receiving material 108.

Accordingly, the photosensitive material 16 and the image receiving material 108 superimposed by the pair of endless belts 122, 124 are held and conveyed by the pair of endless belts 122, 124 in the superimposed state. Further, when the superimposed photosensitive material 16 and the image receiving material 108 are completely between the pair of endless belts 122, 124, the pair of endless belts 122, 124 stop for some time so that the photosensitive material 16 and the image receiving material 108 held therebetween are heated by the heating plate 126. The photosensitive material 16 between the endless belt 122 and the heating plate 126 is heated when being held, conveyed and bought to a stop. A movable pigment is discharged under heat treatment and at the same time the pigment is transferred to a pigment fixing layer on the image receiving material 108. In this way an image can be obtained on the image receiving material 108.

Further, a removing nail 128 is provided on the downstream side in the material supply direction with respect to the pair of endless belts 122, 124. The removing nail 128 engages only with the front edge of the photosensitive material and not the image receiving material 108 also being held and conveyed between the pair of endless belts 122, 124. The removing nail removes the front edge of the photosensitive material 16 projecting from the pair of endless belts 122, 124 from the image receiving material 108 by the edges.

A photosensitive material discharging roller 148 is provided to the left of the removing nail 128 so that the photosensitive material 16 moved leftward while being guided by the removing nail 128 can be further conveyed to a waste photosensitive material storage section 150.

The waste photosensitive material storage section 150 has a drum 152 around which the photosensitive material 16 is wound, and a belt 154 of which a part is wound around the drum 152. The belt 154 is wound around a plurality of rollers 156 so that the belt is spun by the rotation of the rollers 156 and the drum 152 is sat rotating by the belt.

Therefore, if the photosensitive material 16 is inputted with the belt 154 when being spun by the rotation of the roller 156, the photosensitive material 16 can be accumulated around the drum 152.

On the other hand, image receiving material discharging rollers 162, 164, 166, 168, 170 are provided successively for conveying the image receiving material 108 from below the pair of endless belts 122, 124 to the left (FIG. 1). Therefore, the image receiving material 108 discharged from the pair of endless belts 122, 124 is conveyed by the image receiving material discharging rollers 162, 164, 166, 168, 170 and discharged to the tray 172.

The effects and the operation method of this embodiment will now be explained.

In the image recording apparatus 10 with the above-mentioned configuration, the nip roller 18 is operated after setting the photosensitive material magazine 14 so that the photosensitive material 16 is drawn by the nip roller 18. When the photosensitive material 16 is drawn a predetermined length, the cutter 20 is used to cut the photosensitive material 16 to predetermined lengths and the photosensitive material 16 is conveyed to the exposing section 22 with the photosensitive (exposure) surface facing leftward. At the same time as the passage of the photosensitive material 16 through the exposing section 22, the exposing device 38 starts the operation for scanning and exposing an image onto the photosensitive material 16 in the exposing section 22.

After exposure, the photosensitive material 16 is sent to the water application section 50. The conveyed photosensitive material 16 is sent to the jetting tank 312 side by the motion of the conveying roller 32 at the water application section 50 as shown in FIG. 2.

The photosensitive material 16 conveyed along the conveying path A is applied with water sprayed from the jetting tank 312. The operation and the effects will be explained below.

The interlocking pipe 348A for connecting a part of the sub tank 338 below the part communicating with the jetting tank 312 with the water supply pipe 346 and the circulating pipe 348 comprise a part of the circulating path for circulating water The lower discharge valve 362 opens and closes the circulating path. The filter 334 provided in the circulating path filtrates water and the heater 352 heats the water.

Therefore, at the time of starting the operation of the applying device 310, the controller 354 opens the lower discharge valve 362, and the controller 354 starts the operation of the heater 352 and starts the pump 336. Water passes from the water bottle 332, through the filter 334, the heater 352 and the sub tank 338, and further the interlocking pipe 348A and the circulating pipe 348 and returns to the water bottle 332 as shown by the arrow in FIG. 8.

Therefore, even if contaminants, and the like, are present in the water, they can be eliminated by the filter provided in the circulating path so that the nozzle holes 324 of the jetting tank 312 do not get choked. In this way, a stable spraying operation is possible. At the same time, the heater 352 in the circulating path controls the temperature of the water so that the waiting time for jetting of water by the applying device 310 can be reduced. Furthermore, since water is not introduced into the jetting tank 312, there is no need to worry about water leaking from the nozzle holes 324.

At this time, it is also possible to return the water to the water bottle 332 utilizing the interlocking pipe 348B with the upper discharge valve 366 left open.

On the other hand, when water is supplied to fill the jetting tank 312, the controller 354 opens the tank switching valve 364, closes the lower discharge valve 362 and the upper discharge valve 366 in order to pump the water stored in the water bottle 332 to the sub tank 338 side with the upper end open. The sub tank 338 temporarily stores the water so that the water level in the sub tank 338 rises gradually. As shown by the arrow in FIG. 9, water is filled from the sub tank 338 side to the jetting tank 312 connected with the sub tank 338 and the water supply pipe 346.

Figure 9:
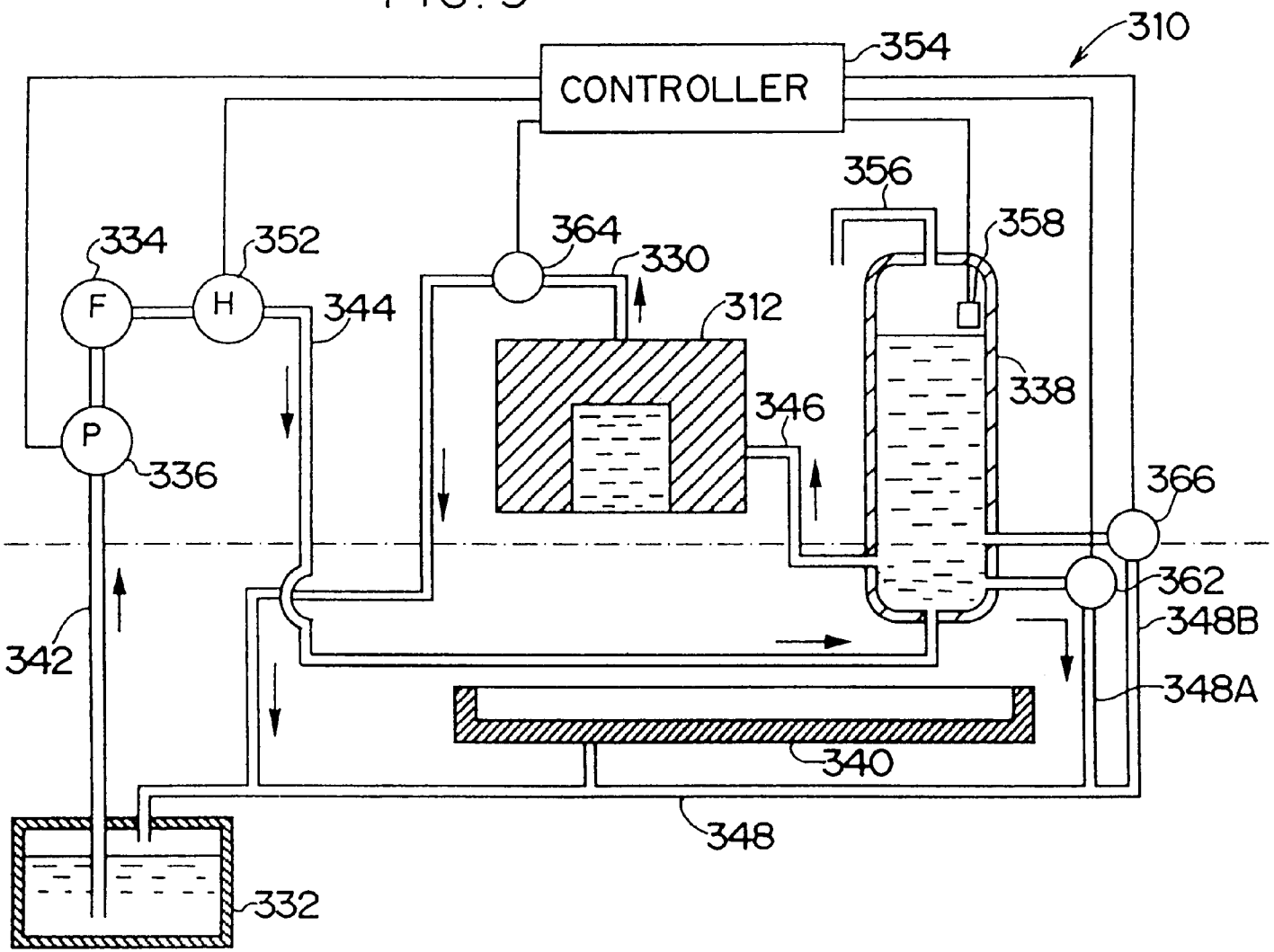
FIG. 9 is a piping diagram of an applying device according to one embodiment of the present invention showing the water flow when water is supplied to the jetting tank.

At this time, the water overflowed from the jetting tank 312 passes through the tank switching valve 364 and is returned to the water bottle 332 as shown by the arrow in FIG. 9.

After filling the water in the jetting tank 312, the water level in the sub tank 338 is raised. The liquid level sensor 358 detects the water level in the sub tank 338 at a position higher than the jetting tank 312. If the water supply pressure and the water supply speed of the pump 336 are detected by the detection 358 of the water level in the sub tank 338 by the liquid level sensor, the detected signal is sent to the controller 354 so as to open the upper discharge valve 366 responsible for opening and closing the interlocking pipe 348B communicating with the sub tank 338 at a position lower than the jetting tank 312. As a result, excess water in the sub tank 338 is discharged by the interlocking pipe 348B and the circulating pipe 348 so as to keep the water level of water stored in the sub tank 338 at a water level lower than the jetting tank 312 (FIG. 10).

Figure 10:
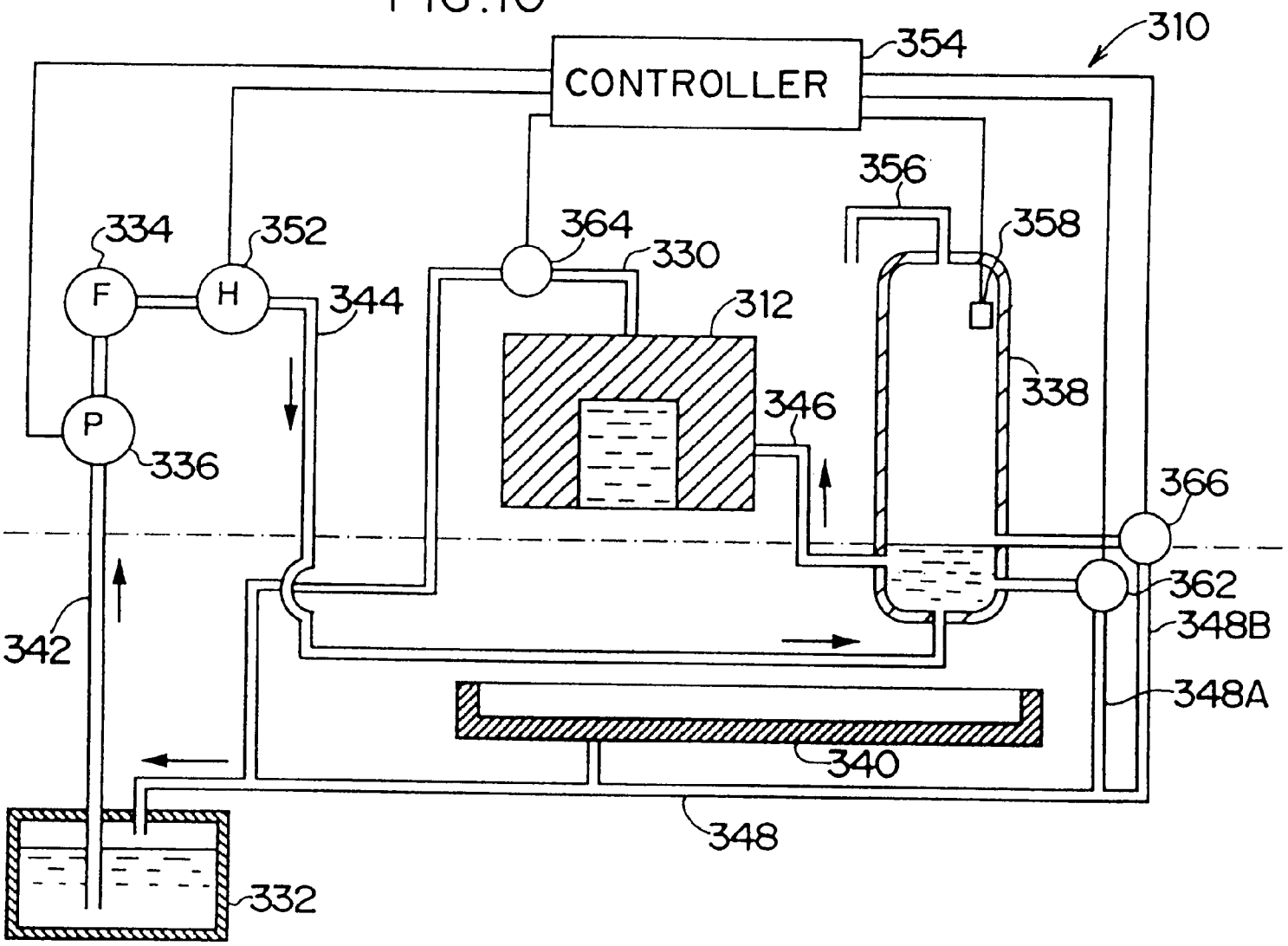
FIG. 10 is a piping diagram of an applying device according to one embodiment of the present invention, showing the water flow during the spraying operation.

Further, when the upper discharge valve 366 is opened, the tank switching valve 364 provide communicating with the jetting tank 312 and previously opened is closed by the controller 354 so as to maintain the water level of the water filled into the jetting tank 312 (in FIG. 10).

The tank switching valve 364 is closed when the water level in the sub tank 338 has been reduced by predetermined amount. This prevents water leaking from the nozzle holes 324 due to the impact of closing the tank switching valve 364.

Accordingly, the plurality of nozzle holes 324 provided in the jetting tank 312 can jet water under conditions where the inside of the jetting tank 312 is maintained at a constant negative pressure and the water level of the water in the jetting tank 312 is maintained.

Furthermore, since the sub tank 338 for temporarily storing water is provided between the water bottle 332 for storing water and the jetting tank 312, bubbles, which can be introduced during the exchange of water or exchange of the filter 334, can be absorbed by the sub tank 338 when supplying water to the jetting tank 312. In this way, bubbles are not introduced into the jetting tank 312 and thus a stable spraying operation is possible. Further, since the sub tank 338 is provided between the water bottle 332 and the jetting tank 312, excessive water pressure is not applied to the jetting tank 312 from the pump 336, and the like, when supplying water. This means that water leakage from the nozzle holes 324 can be prevented.

Accordingly, water needs not be supplied to the jetting tank 312 with great caution so that the waiting time before starting the jetting operation of water by the applying device 310 can be reduced.

Then, the water is atomized and jetted by the jetting tank 312. At this time, voltage is applied to the piezoelectric elements 326 by supplying electric power from the power source controlled by the controller 354 in order to deform and elongate all the piezoelectric elements 326 simultaneously.

That is, as shown in FIG. 7, if the plurality of the piezoelectric elements 326 elongate simultaneously, the nozzle plates 322 near the nozzle holes 324 provided while interposed between the pair of the lever plates 320 are moved back and forth in the direction of the photosensitive material 16 on the conveying path A (in this case, moving in the direction of arrow B FIG. 7) as the pair of the lever plates 320 vibrate around the supporting parts 312B so that the nozzle plates 322 apply pressure to the water inside the jetting tank 312.

Accordingly, the water filled in the jetting tank 312 is jetted from the plurality of the nozzle holes 324 according to the operation of the piezoelectric elements 326. As a result, the water filled in the jetting tank 312 is atomized, jetted from the nozzle holes 324 and applied to the photosensitive material 16 being conveyed (FIG. 7).

On the other hand, water charge into the jetting tank 312 becomes necessary because of the spraying operation of jetting water from the plurality of the nozzle holes 324 of the jetting tank 312. As shown in FIG. 10, since the sub tank 338 for maintaining the water level of the stored water at a water level lower than the jetting tank 312 is provided between the water bottle 332 and the jetting tank 312, water pressure changes, and the like, occurring when charging water by pump 336 can be offset by the sub tank 338. Therefore, the water pressure of the water filled in the jetting tank 312 does not change and thus a stable spraying operation is possible.

In other words, by operating the pump 336 at low speed during the spraying operation, the water level in the sub tank can be kept constant. At the same time, water is charged from the sub tank 338 to the jetting tank 312 by virtue of the pressure difference between the negative pressure jetting tank 312 and the sub tank.

Since the tank switching valve 364 provided communicating with the jetting tank 312 functions to open and close the inside of the jetting tank 312 when the controller 354, judges, a certain time after the spraying operation, that the spraying operation is finished, the controller 354 opens the tank switching valve 364.

Accordingly, the water filled in the jetting tank 312 flows backwards in the water supply pipe 346 to the sub tank 338 side, and further through the interlocking pipe 348B and the circulating pipe 348 and finally back to the water bottle 332.

By discharging water from the jetting tank 312 so as to have the inside of the sub tank 338 keeping water, the water supply time to the jetting tank 312 at the time of restarting the spraying operation can be reduced and choking of the nozzle holes 324 by scale, and the like, can be prevented.

By circulating water by operating the pump 336 at certain intervals in this state to pass through the heater 352, the water temperature in the sub tank 338 can be kept constant. Further, when a certain time is passed in this state, the controller 354 judges that the spraying operation is completely over and opens the lower discharge valve 362 thus returning all the water to the water bottle 332.

The piezoelectric elements 326 are operated during the spraying operation of the jetting tank 312. Since the lever plates 320 sway around the supporting parts 312B elongating along the direction of the plurality of the nozzle holes 324 linearly arranged according to the piezoelectric element 326 operation, the entire part of the nozzle parts 322 provided with the plurality of the nozzle holes 324 is displaced uniformly. Therefore, the nozzle holes 324 can be displaced stably with the same displacement amount along the longitudinal direction of the nozzle row formed with the plurality of the nozzle holes 324 linearly arranged so that the water filled in the jetting tank 312 can be jetted from the plurality of the nozzle holes 324 homogeneously. Therefore, in addition to having the nozzle plates 322 as the bottom wall surface of the jetting tank 312, it becomes less likely that parts of the photo sensitive material 16 are missed by the water.

On the other hand, since the jetting tank 312 has the nozzle holes 324 and jets the water from the nozzle holes 324, application is possible with only a small amount of water and the photosensitive material 16 can be dried in a short time when compared to an applying device in which a photosensitive material, and the like, is soaked in a vessel filled with water.

Further, by jetting the water from the nozzle holes 324 a large number of times with optional timing in combination with the conveying speed of the photosensitive material 16, water can be applied on the entire surface of the photosensitive material 16.

Thereafter, the photosensitive material 16 applied with water acting as the image forming solvent in the water applying section 50 is sent between the pair of endless belts 122, 124 of the heat developing transfer section 120 by the conveying roller 34.

On the other hand, the image receiving material 108 is also drawn and conveyed from the image receiving material magazine 106 by the nip roller 110 as the photosensitive material 16 is scanned and exposed. When the image receiving material 108 has been drawn for a predetermined length, the cutter 112 is operated to cut the image receiving material 108 at predetermined lengths.

After operating the cutter 112, the cut image receiving material 108 is conveyed by the conveying rollers 132, 134, 136, 138 while being guided by the guide plate. When the front edge of the image receiving material 108 is held by the conveying roller 138, the image receiving material 108 is on stand-by right in front of the heat developing transfer section 120.

As mentioned above, as the photosensitive material 16 is sent between the pair of endless belts 122, 124 by the conveying roller 34, the conveyance of the image receiving material 108 is resumed so that the image receiving material 108 is sent between the pair of endless belts 122, 124 with the photosensitive material 16.

As a result, the photosensitive material 16 and the image receiving material 108 are superimposed. The photosensitive material 16 and the image receiving material 108 are held and conveyed while being heated by the heating plate 126 so that an image is formed on the image receiving material 108 by the heat developing transfer.

Further, when they are discharged from the pair of endless belts 122, 124, the removing nail 128 is engaged to the front edge of the photosensitive material 16 being conveyed ahead of the image receiving material 108 by a predetermined distance. The nail removes the front edge of the photosensitive material 16 from the image receiving material 108. The photosensitive material 16 is conveyed further by the photosensitive material discharge roller 148 and collected in the waste photosensitive material storage section 150. At this time, since the photosensitive material 16 soon dries, a heater is not required.

On the other hand, the image receiving material 108 separated from the photosensitive material 16 is conveyed by the image receiving material discharge rollers 162, 164, 166, 168, 170 and discharged into the tray 172.

When the image recording process is conducted for a number of sheets, this process is repeated over and over.

The image receiving material 108 carrying an image formed (recorded) by the heat developing transfer process between the pair of endless belts 122, 124 is held and conveyed by the plurality of image receiving material discharge rollers 162, 164, 166, 168, 170 after being discharged from the pair of endless belts 122, 124 and discharged outside the apparatus.

Although a one line nozzle row was discribed in the above-mentioned embodiment, it is not limited to just one line. It may consist of more than one line. By increasing the number of the nozzle lines, the driving frequency of the actuator can be further reduced. Further, although the nozzle row was described at a right angle to the conveying direction in the above-mentioned embodiment, it is not limited to this. It may be provided diagonally with respect to the conveying direction.

Although the photosensitive material 16 and the image receiving material 108 are used as the image recording materials, water is applied to the photosensitive material 16 after exposure by the jetting tank 312 of the applying device 310 in the above-mentioned embodiment so as to conduct the heat developing transfer with the photosensitive material 16 and the image receiving material 108 superimposed in the above-mentioned embodiment. However, it is not limited to this alone. Water can also be applied by jetting the image receiving material 108.

Furthermore, materials are not limited to those above. Other sheet-like or roll-like image recording materials can be adopted as well, and image forming solvents other than water can be used and applied for the application of a developer to photographic paper in a developing device for, the application of soaking water in a printer, for use in a coater, and the like.

As heretofore explained, a liquid jetting apparatus and an operation method of the liquid jetting apparatus of the present invention have an excellent effect of achieving stable spraying while reducing the waiting time and cutting water leakage from the nozzle holes.

What is claimed is:

1. A liquid jetting apparatus comprising:

a bottle for storing an image forming solvent, a sub tank having an upper end and a lower end and able to temporarily store the image forming solvent, a pump for sending the image forming solvent from the bottle to the sub tank side, a jetting device communicating directly with the sub tank so as to be filled with the image forming solvent from the sub tank side, provided with a plurality of nozzle holes for jetting the image forming solvent, and a discharge pipe communicating with the lower end of the sub tank at a position lower than the jetting device so as to keep a liquid level of the image forming solvent stored in the sub tank constant.

2. A liquid jetting apparatus comprising:

a bottle for storing an image forming solvent, a sub tank able to temporarily store the image forming solvent, a pump for sending the image forming solvent from the bottle to the sub tank side, a jetting device communicating directly with the sub tank so as to be filled with the image forming solvent from the sub tank side, provided with a plurality of nozzle holes for jetting the image forming solvent, a circulating pipe, connecting the bottle and a part of the sub tank lower than a part communicating with the jetting device so as to comprise a part of a circulating path, for circulating the image forming solvent, a circulating path switching valve provided in the circulating pipe for opening and closing the circulating path, and a filter provided in the circulating path for filtrating the image forming solvent.

3. A liquid jetting apparatus according to claim 2, further comprising a heater provided in the circulating path for keeping the image forming solvent at a constant temperature.

4. An operation method of a liquid jetting apparatus comprising the steps of:

filling an image forming solvent into a jetting device which communicates with a sub tank into which sub tank the image forming solvent so far stored in a bottle is sent with a pump to be temporarily stored, opening a liquid level adjusting valve for opening and closing a discharge pipe communicating with the sub tank to maintain a liquid level of the image forming solvent stored in the sub tank constantly at a level lower than the jetting device, jetting the image forming solvent from a plurality of nozzle holes provided in the jetting device, and opening a jetting device switching valve for opening and closing in the jetting device so as to discharge the image forming solvent in the jetting device after finishing a jetting operation of the image forming solvent.

5. An operation method of a liquid jetting apparatus according to claim 4, further comprising a step of filling the image forming solvent in the jetting device to keep the liquid level in the sub tank at a liquid level lower than the jetting device and closing the jetting device switching valve previously opened.

6. An operation method of a liquid jetting apparatus according to claim 5, further comprising a step of circulating the image forming solvent in the circulating path from the bottle and back to the bottle via the sub tank to eliminate at least contaminants, from the image forming solvent with a filter provided in the circulating path before filling the image forming solvent into the jetting device.

7. An operation method of a liquid jetting apparatus according to claim 6, further comprising the steps of discharging the image forming solvent from the jetting device so as to be returned to the sub tank, and circulating the image forming solvent in the circulating path at set time intervals to keep a temperature of image forming solvent at a predetermined temperature with a heater provided in the circulating path.

8. An operation method of a liquid jetting apparatus according to claim 5, further comprising a step of discharging the image forming solvent from the jetting device so as to be returned to the sub tank, and circulating the image forming solvent in the circulating path at set time intervals to keep a temperature of the image forming solvent at a predetermined temperature with a heater provided in the circulating path.

9. An operation method of a liquid jetting apparatus according to claim 4, further comprising a step of circulating the image forming solvent in the circulating path from the bottle and back to the bottle via the sub tank to eliminate at least contaminants from the image forming solvent with a filter provided in the circulating path before filling the image forming solvent into the jetting device.

10. An operation method of a liquid jetting apparatus according to claim 9, further comprising the steps of discharging the image forming solvent from the jetting device so as to be returned to the sub tank, and circulating the image forming solvent in the circulating path at set time intervals to keep a temperature of the image forming solvent at a predetermined temperature with a heater provided in the circulating path.

11. An operation method of a liquid jetting apparatus according to claim 4, further comprising the steps step of discharging the image forming solvent from the jetting device so as to be returned to the sub tank, and circulating the image forming solvent in the circulating path at set time intervals to keep a temperature of the image forming solvent at a predetermined temperature with a heater provided in the circulating path.

12. A liquid jetting apparatus comprising:

a bottle for storing an image forming solvent, a sub tank having an upper end and a lower end and able to temporarily store the image forming solvent, a pump for sending the image forming solvent from the bottle to the sub tank side, a jetting device communicating with the sub tank so as to be filled with the image forming solvent from the sub tank side, provided with a plurality of nozzle holes for jetting the image forming solvent, a discharge pipe communicating with the lower end of the sub tank at a position lower than the jetting device so as to keep a liquid level of the image forming solvent stored in the sub tank constant, and a liquid level adjusting valve provided in the discharge pipe for opening and closing the discharge pipe, for discharging excess image forming solvent from the sub tank so as to keep the liquid level of the image forming solvent stored in the sub tank at a liquid level lower than the jetting device in an open state of the liquid level adjusting valve.

13. A liquid jetting apparatus according to claim 12, further comprising a jetting device switching valve, communicating with the jetting device for opening and closing the inside of the jetting device.

14. A liquid jetting apparatus according to claim 13, further comprising an overflow channel for connecting the jetting device and the bottle via the jetting device switching valve.

15. A liquid jetting apparatus according to claim 12, further comprising a jetting devices witching valve, communicating with the jetting device for opening and closing an inside of the jetting device.

16. A liquid jetting apparatus according to claim 15, further comprising a sensor for detecting when the liquid level in the sub tank is at a position higher than the jetting device.

17. A liquid jetting apparatus according to claim 16, further comprising an overflow channel for connecting the jetting device and the bottle via the jetting device switching valve.

18. A liquid jetting apparatus according to claim 15, further comprising an overflow channel for connecting the jetting device and the bottle via the jetting device switching valve.

19. A liquid jetting apparatus according to claim 12, further comprising a sensor for detecting when the liquid level in the sub tank is at a position higher than the jetting device.

* * * * *